US009443374B2

(12) United States Patent
Shuliar

(10) Patent No.: US 9,443,374 B2
(45) Date of Patent: Sep. 13, 2016

(54) METHOD AND SYSTEM FOR PLAYING A GAME

(71) Applicant: Timofey Viktorovich Shuliar, Sankt-Peterburg (RU)

(72) Inventor: Timofey Viktorovich Shuliar, Sankt-Peterburg (RU)

( * ) Notice: Subject to any disclaimer, the term of this patent is extended or adjusted under 35 U.S.C. 154(b) by 92 days.

(21) Appl. No.: 14/374,203

(22) PCT Filed: Mar. 6, 2014

(86) PCT No.: PCT/RU2014/000153
§ 371 (c)(1),
(2) Date: Jul. 23, 2014

(87) PCT Pub. No.: WO2015/133924
PCT Pub. Date: Sep. 11, 2015

(65) Prior Publication Data

US 2015/0251086 A1 Sep. 10, 2015

(51) Int. Cl.

| | |
|---|---|
| ***A63F 3/06*** | (2006.01) |
| ***G07F 17/32*** | (2006.01) |
| *A63F 11/00* | (2006.01) |
| *A63F 7/04* | (2006.01) |

(52) U.S. Cl.
CPC ..... *G07F 17/32* (2013.01); *A63F 3/062* (2013.01); *A63F 3/06* (2013.01); *A63F 7/045* (2013.01); *A63F 7/048* (2013.01); *A63F 11/00* (2013.01); *A63F 11/0002* (2013.01); *A63F 11/0011* (2013.01)

(58) Field of Classification Search
CPC ..... A63F 7/045; A63F 7/048; A63F 11/00; A63F 11/0011; A63F 11/0002; A63F 3/06
USPC ..... 273/144 B, 144 A, 144 R, 145 R, 145 A, 273/145 B, 145 C, 145 CA, 138.5, 138.3, 273/138.1
See application file for complete search history.

(56) References Cited

U.S. PATENT DOCUMENTS

| | | | | |
|---|---|---|---|---|
| 2,752,725 A * | 7/1956 | Unsworth | A63F 7/042 | 273/109 |
| 3,754,763 A * | 8/1973 | Breslow | A63F 3/00145 | 273/243 |
| 5,039,101 A * | 8/1991 | Potter | G07C 15/003 | 273/144 B |
| 5,050,882 A * | 9/1991 | Yang | A63F 7/045 | 273/144 B |
| 5,328,173 A * | 7/1994 | Stern | A63F 7/048 | 273/144 B |
| 5,718,428 A * | 2/1998 | Almira | A63F 7/048 | 273/138.1 |

FOREIGN PATENT DOCUMENTS

| | | | | |
|---|---|---|---|---|
| GB | 2305615 A * | 4/1997 | A63F 7/045 |

* cited by examiner

*Primary Examiner* — Benjamin Layno
(74) *Attorney, Agent, or Firm* — Matthew A. Pequignot; Pequignot + Myers LLC

(57) ABSTRACT

A method and system for randomly selecting numbers for playing a game using a random arrangement of numbered balls placed on an ice layer, or in an ice layer in a capacity. Conditions are created for thawing the ice and allowing the numbered balls to sink and fall exiting the bottom of the capacity. A device below the capacity comprises a detector for sensing a numbered ball that is exiting. A remotely accessed game server enables game players to place stakes on the numbered balls exiting. The detector sensing a numbered ball exiting, communicates with the game server to stop accepting stakes for the numbered balls to be exited.

19 Claims, 4 Drawing Sheets

METHOD AND SYSTEM FOR PLAYING A GAME

FIELD OF THE INVENTION

The present invention relates to conducting drawing lotteries.

BACKGROUND OF THE INVENTION

For more than 100 years lotteries and Bingo games are known where the use of balls is provided to randomly select numbers.

At the same time, the method of playing a game is constantly improved, and the prior art discloses (see U.S. Pat. No. 8,128,089 of Jun. 3, 2012) a method of playing a game comprising mixing and providing exit of numbered balls. This known method is the closest to the claimed method.

U.S. Pat. No. 8,128,089 of Jun. 3, 2012 describes as well a system for playing a game, comprising a device for mixing and performing exit of numbered balls, provided with the detector of an exited numbered ball, and the device itself for mixing and providing exit of numbered balls comprises means for mixing numbered balls and an exit tube for numbered balls.

The known methods and systems for conducting games with the use of balls do not foresee the use of the first ball in the game at a random instant or do not foresee any rise of random down time intervals between the use of following balls in the game.

DESCRIPTION OF THE INVENTION

The technical result obtained by the claimed invention is a random value of the instant of the first numbered ball to be exited and random values of time intervals between the instants of the following numbered balls to be exited. At the same time, the said random process can be watched by the game players, and the last have a possibility not only to watch the said random process but to stake until the moment of performance of said random events, by pulling out balls.

Said technical result is obtained by a method of playing a game, comprising formation of ice on which or in which numbered balls are randomly arranged, and conditions are created for further ice thawing, for falling through and dropping of exited numbered balls.

The numbered balls can be randomly arranged on the ice surface after mixing them.

In an ice layer, the numbered balls can be positioned randomly, while placing them first, before the ice formation, into some liquid and mixing the same in the last, the liquid being cooled down and frozen together with the balls.

Before the formation of ice in which the numbered balls are randomly arranged, said numbered balls can be placed into some liquid with ice fragments or with icy structures and submitted to mixing, the liquid with said ice fragments or icy structures is to be cooled and frozen together with the balls.

Likewise, before the formation of ice in which or on which the numbered balls are randomly arranged, said numbered balls can be previously cooled, mixed and randomly thrown (simultaneously and/or successively) into some supercooled liquid, in particular water, which will result in liquid crystallization and in as ice layer formation. The supercooled liquid is a liquid having a temperature below the crystallization point for a given pressure.

The game players can watch, with the use of remote access means, the game course and stake for the number of the following numbered ball falling down from the thawing frozen liquid (ice), the staking on the numbered ball falling down from the thawing ice and pulled out can be automatically stopped, and the players can be informed about the end of stake accepting.

The specified technical result is obtained in a system for playing a game, comprising a device for providing exit of numbered balls, featuring a detector of an exited numbered ball, a game server for staking, made with the possibility to communicate with the remote access means, enabling the game players to stake, the device performing the exit of numbered balls being made with the possibility to place or to form an ice layer on which or in which numbered balls are arranged, to provide further ice thawing, falling through and dropping of exited numbered balls, the detector of the exited numbered ball being in communication with the game server to stop loading on the game server stakes for the exited numbered ball.

The system can additionally comprise an Internet site server communicating with the game server and enabling to watch online the game course, as well as to stake with the use of the remote access means.

The system can additionally comprise a device for mixing numbered balls, made and arranged with the possibility of dropping the numbered balls after mixing them, for example a rotating drum with an opening aperture for falling down of numbered balls into a capacity located below and filled with some supercooled liquid, in particularly water, a device for pulling out of numbered balls, provided with means for cooling the liquid in the capacity to a temperature below the crystallization point of this liquid.

The device for mixing numbered balls can be made with a transparent housing enabling to watch the mixing of numbered balls and with the possibility to cool the numbered balls contained in the same.

The specified technical result is obtained as well in a device performing the exit of numbered balls, comprising a capacity, made with the possibility to place in it some ice, in particular, a layer of ice on which or in which numbered balls can be arranged, wife the possibility of further ice thawing, falling tough or dropping of the numbered balls to be exited, and an exit tube for the numbered balls exited from said capacity. The formation of an ice layer could be performed in the same capacity or in another one. For a random arrangement of numbered balls in the body of the ice layer, the mixing of the same could be carried out, respectively, in the same capacity or in a different one. Random distribution of the numbered balls on the ice layer should be performed with a device external to the claimed device providing the exit of numbered balls.

The device can be provided with a detector finding the numbered ball to be exited.

The device can be provided with a valve mounted in the exit tube for numbered balls and provided with a detector of a ball located above the same and with a drive actuated by the detector and opening the valve to let the ball pass through it.

The capacity in which the numbered balls can be arranged on the ice or in the ice body can be made with the possibility to be filled with some liquid and to form an ice layer, and can comprise means for cooling and freezing liquids.

The means for mixing numbered balls can be made as a means for delivering gas into liquid to mix the numbered balls contained in the last until freezing the liquid.

The means for mixing numbered balls can be made as a water pump generating the vortex movement of the liquid in order to mix the numbered balls contained in the same until freezing the liquid.

EMBODIMENT OF THE INVENTION

Figure 1:
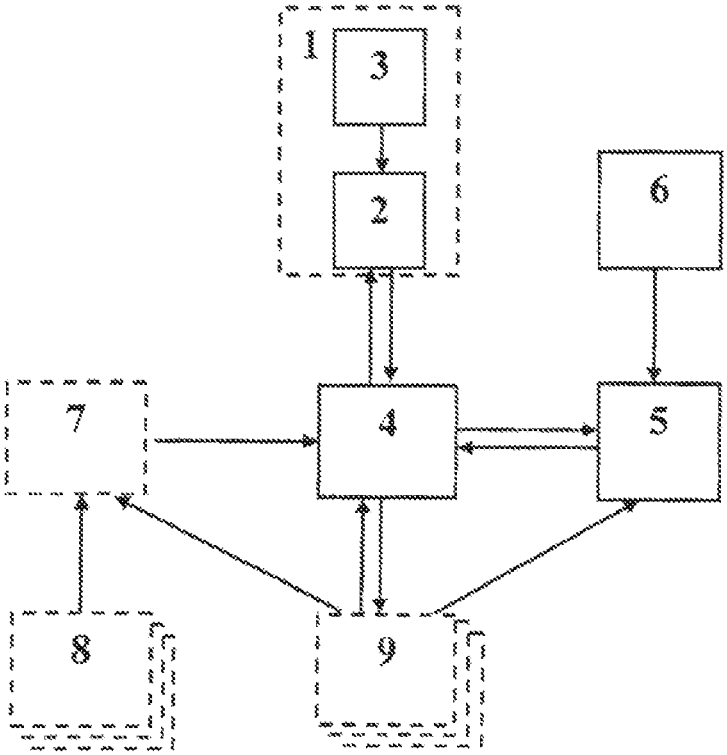
FIG. 1 represents a block diagram of the system carrying out the game management.

According to the block diagram of FIG. 1, the system of playing a game comprises a device 1 for performing the exit of numbered balls, provided with a control unit 2 and a detector 3 of the numbered ball to be exited, a game server 4 enabling staking and an Internet site server 5. The site server 5 is connected with a means 6 for retransmitting the game course and provides for online retransmitting of the game on the Internet site.

The game server 4 is connected to a server 7 of the payment system accepting payments via terminals 8 of the payment system from the game players making stakes, and to terminals 9 of the game players. The game players can as well make stakes via their terminals 9 on the Internet site located at the server 5, or via the server 7 of the payment system.

Figure 2:
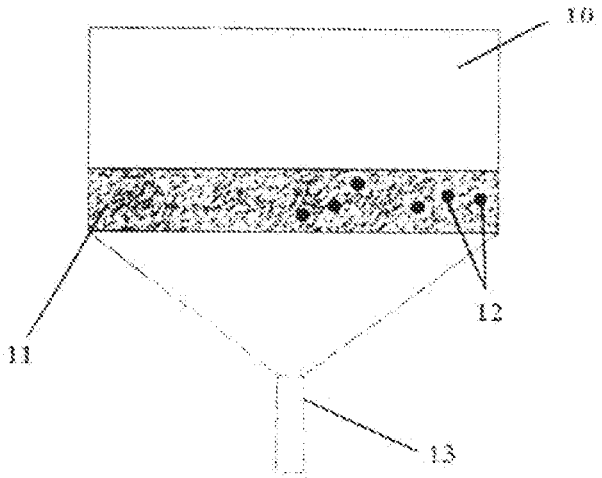
FIGS. 2, 3, 4, 5 and 6 represent devices for performing the exit of numbered balls.

In this way, the game players have the possibility to watch the game and to stake. A particularity of the claimed method of playing a game is a random value of the instant of the first numbered ball dropping and exit and random values of time intervals between the exits of the following numbered balls. In this case, the stakes can be made before onset of said random events. To provide said particularity of the game, use is made of a device for bringing out numbered balls, comprising, as shown is FIG. 2, a capacity 10 made with transparent walls and having the possibility to place an ice layer 11 in the same, this layer containing numbered balls 12, with the possibility to provide thawing of the ice, falling through of the numbered balls to be exited, and a tube 13 for bringing out numbered balls 12 from said capacity 10. An ice layer containing numbered balls can be formed in a different device providing for a random arrangement of the balls in the ice body.

Figure 3:
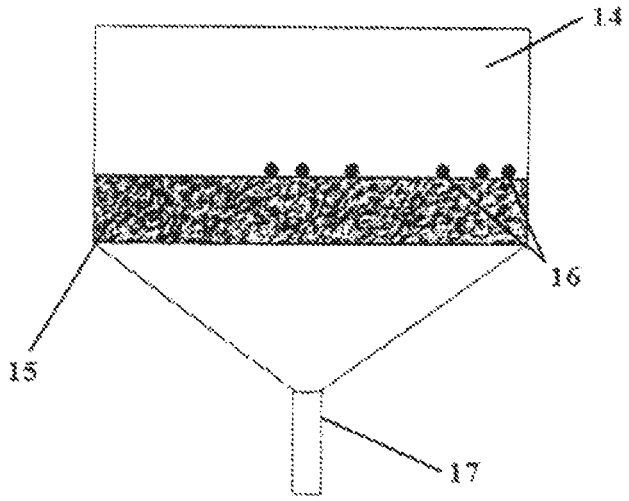

A similar device for bringing out numbered balls, shown in FIG. 3 comprises a capacity 14 made with transparent walls and with the possibility to place an ice layer 15 in the same, this layer supporting numbered balls 16, with the possibility to provide thawing of the ice, falling through of the numbered balls to be exited, and a tube 17 for bringing out numbered balls 16 from said capacity 14. An ice layer can be formed in a different device. To provide a random arrangement of numbered balls on the ice surface, use is made of a device that represents an external device for bringing oat numbered balls, that mixes the numbered balls and pours them out onto the ice surface.

Figure 4:
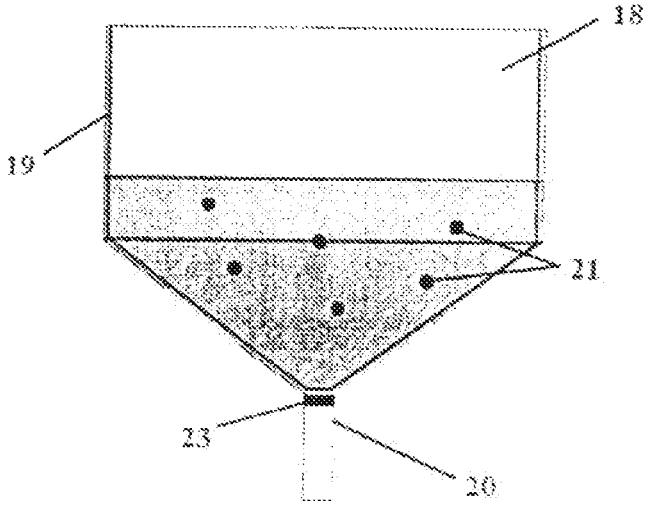

Another embodiment of a device for bringing out numbered balls, shown in FIG. 4, comprises: a capacity 18 for the liquid, made with transparent walls having an interspace 19 between them filled with cooling agent for freezing the liquid in the capacity 18; a tube 20 for bringing out numbered balls 21 from said capacity 18, and a pump 22 providing circulation of the liquid in the capacity 18 and mixing of the balls.

The tube 20 is provided with an automatic valve 23 having a drive and a detector of the location of the numbered ball to be exited above the valve. The valve 23 is open to let one numbered ball pass into the tube 20, when said ball is located above the valve and when the detector operates. The detector can be, for example, optical or represent a Hall detector.

With the device for bringing out numbered balls, shown in FIG. 4, the method of playing a game is carried out as follows.

The numbered balls 21 having some negative floatability are placed into the capacity 18 filled with water and the pump 22 is put into operation to mix the balls in the capacity 18. Thanks to the transparent walls of the capacity 18, the mixing process and the subsequent operations with the numbered balls 21 are watched with video cameras and are transmitted to the Internet site. In parallel, the game course can be translated on television.

Then, between the walls of the capacity 18, cooling agent is poured and constantly added, as it is consumed and evaporated. As a result of cooling, the water is frozen, its circulation and mixing of numbered balls stop. After freezing up of water containing the balls, the cooling agent is removed from the space between the walls of the capacity 18, and the ice thawing process starts. As the thawing goes on, ice rises to the surface of the water formed, primarily near the walls of the capacity 18. A ball situated closer to the limit of the thawing ice than the others is released and sinks down is the water formed, moving to the mouth of the exit tube for numbered balls, and falls down onto the valve that operates after a signal of the detector sensing the ball and lets the ball pass into the tube with some amount of water. Under the effect of gravity, the ball passes the exit tube and gets into a hopper where its number is exhibited. A detector signal that opens the closure gets as well to the game server 4 (FIG. 1) that stops the staking for guessing the number of the exited ball. At the same time, the game server 4 reports about cessation of accepting stakes to the server 5 on the Internet site and informs the users.

Then the game server 4 accepts stakes until falling down of another numbered ball from the ice body. After falling down of the second ball and after entry of the same onto the valve of the exit tube, the detector operates once more, it opens the valve and informs the server 4 of the need to stop accepting stakes.

Thus, the sake accepting procedure resumes until falling down of all the balls foreseen by the rules of the game. The server 4 calculates the amounts of wins and transmits the information on the wins to the server 5 of the Internet site and to the winning game players.

Figure 5:
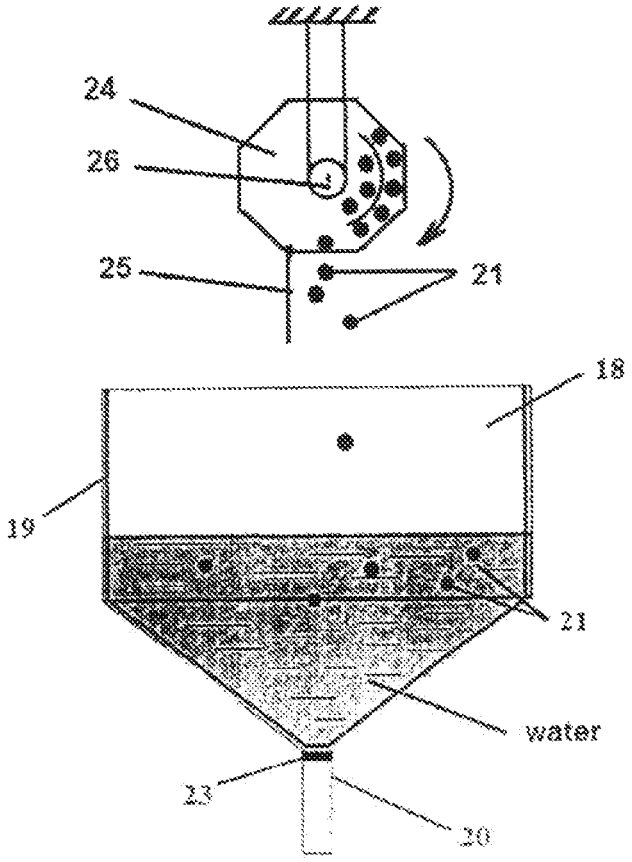
Figure 6:
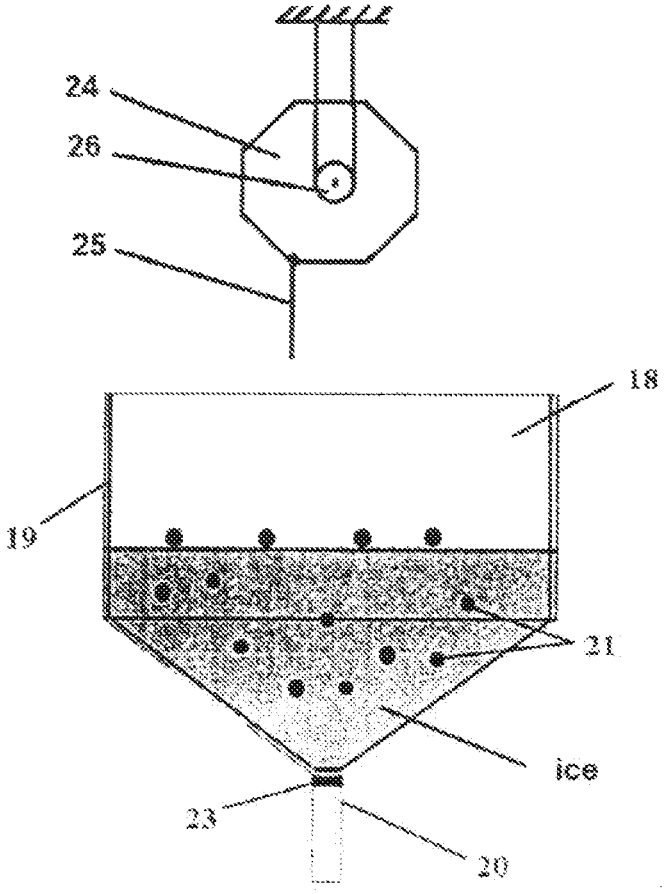

The system of playing a game can comprise another embodiment of the device for bringing out numbered balls, shown in FIGS. 5 and 6, and comprises: a capacity 18 for the liquid, made with double transparent walls having a gap 19 between them, filled with cooling agent, for cooling the liquid in the capacity 18 to a temperature below the crystallization point of this liquid.

In this case, the system of playing a game comprises as well a device for mixing numbered balls, mounted above the capacity 18 and made as a drum 24 with transparent walls, provided with an opening valve 25. The drum is provided with a motor 26 rotating the same together with the numbered balls 21 (not shown).

After mixing the balls or during their mixing, when the valve 25 opens, the numbered balls (see FIG. 5) fall down into the capacity 18 containing supercooled water (temperature about −3° C.). After falling down of the first balls into the supercooled water, the crystallization process and ice formation start. For this reason, the following balls enter the capacity 18 at lesser depth. The last balls (see FIG. 6) can remain on the ice surface.

Later on, everything occurs similarly to the previous example. As the ice thaws, the balls fall down from the same, sink into the water formed, pass by the exit tube and get into the hopper where the number of the same is exhibited. The detector signal opening the valve comes as well to the game server 4 (FIG. 1) that stops accepting the stakes guessing the number 1 of the first ball drawn. At the same time, the game server 4 informs about cessation of accepting stakes to the server 5 of the Internet site and notifies the users. Later on, the game server 4 accepts stakes until falling down of another numbered ball from the ice body. Upon falling down of the second ball and transferring of the same to the exit tube valve, the detector operates once more, it opens the valve and informs the server 4 about the need to stop accepting stakes. The procedure of accepting stakes resumes until falling down of all the balls foreseen by the rules of the game. The server 4 calculates the amounts of wins and transmits the information on the wins to the server 5 of the Internet site and to the winning game players.

The invention claimed is:

1. A method of operating a lottery game, comprising
providing a plurality of numbered balls;
mixing and randomly arranging the plurality of numbered balls in or on a layer of ice in a capacity with a transparent window;
thawing the layer of ice until a first one of the numbered balls sinks and falls through the bottom of the capacity; and
providing an exit tube at the bottom of the capacity for bringing out the numbered balls from the capacity through the exit tube at least until a first ball of said plurality of numbered balls exits through said exit tube under the effect of gravity.

2. The method of claim 1, wherein the step of mixing and randomly arranging the plurality of numbered balls comprises:
mixing the plurality of numbered balls in a device for mixing balls; and
randomly placing the plurality of numbered balls on the surface of the ice layer.

3. The method of claim 1, wherein the step of mixing and randomly arranging the plurality of numbered balls comprises:
placing said numbered balls into a liquid;
mixing the numbered balls in the liquid; and
cooling the liquid until frozen together with the numbered balls.

4. The method of claim 1, wherein the step of mixing and randomly arranging the plurality of numbered balls comprises:
placing said numbered balls into a liquid with ice fragments or with icy structures;
mixing the numbered balls in the liquid with the ice fragments or with the icy structures; and
cooling the liquid until frozen together with the numbered balls.

5. The method of claim 1, wherein the step of mixing and randomly arranging a plurality of numbered balls comprises:
mixing the plurality of numbered balls in a device for mixing balls; and
pouring the plurality of numbered balls into a supercooled liquid, which results in the crystallization of the liquid and the formation of ice.

6. The method of claim 1, further comprising the steps of:
enabling lottery game players, using means for remote access, to watch the lottery game course,
enabling the lottery game players to make stakes to the number of the following numbered ball falling down under the effect of gravity from the thawing ice,
automatically stopping the making of stakes after at least one of the numbered balls has entered the exit tube and
notify the lottery game players about the cessation of making stakes.

7. A system for operating a lottery game, comprising:
a capacity for supporting and forming a layer of ice, the capacity including a transparent window;
a plurality of numbered balls for placing in or on the layer of ice in the capacity;
an exit tube located at the bottom of the capacity for bringing out numbered balls from the capacity when the plurality of numbered balls sink and fall through the bottom of the capacity and exit the exit tube under the effect of gravity as the sheet of ice thaws
a detector of a numbered ball to be exited in the exit tube,
a game server for communicating with means for remote access enabling lottery game players to make stakes,
wherein the detector of a numbered ball is capable of communicating with the game server to stop accepting stakes for the numbered ball to be exited.

8. The system of claim 7, further comprising:
a server of the Internet site, linked to the game server, enabling lottery game players to watch the game course and to make stakes, using the means for remote access.

9. The system of claim 7, further comprising a device for mixing numbered balls, whereby the numbered balls fall down under the effect of gravity after mixing into the capacity;
wherein the capacity comprises a supercooled liquid, and a means of cooling the liquid to a temperature below the crystallization point of said liquid.

10. The system of claim 9, wherein the device for mixing numbered balls includes:
a transparent housing enabling watching the mixing of the numbered balls; and
a cooler to cool down the numbered balls located therein.

11. A device for selecting numbered balls, comprising:
a plurality of numbered balls;
a capacity with a transparent wall, the capacity enabling the placement or formation of ice on which or in which the numbered balls are arranged in the capacity, and
an exit tube at the bottom of the capacity for receiving the numbered balls when the ice thaws enabling the numbered balls to sink and fall through the bottom of the capacity under the effect of gravity and exit the exit tube.

12. The device of claim 11, further comprising a detector sensing the numbered ball to be exited.

13. The device of claim 11, further comprising:
a valve located in the exit tube for the numbered balls,
a detector sensing the occurrence of one of the numbered balls above the valve, and
a valve drive that opens the valve to let the numbered ball pass into the exit tube when the detector detects the numbered ball.

14. The device of claim 11, wherein the capacity is capable of being filled with liquid and to form ice, and
wherein the device further comprises means for cooling and freezing the liquid in the capacity.

15. The device of claim 14, further comprising means for supplying gas into the liquid contained in the capacity in order to mix the numbered balls contained in the same until the formation of ice containing the numbered balls.

16. The device of claim 14, further comprising a water pump for generating a vortex of the liquid to mix the numbered balls contained in the same, until freezing of the liquid.

17. A method of operating a lottery game, comprising the steps of:

placing a plurality of numbered balls in a liquid within a capacity with a transparent wall, linked to an exit tube at the bottom of the capacity for the numbered balls, mixing said liquid together with the plurality numbered balls in said capacity;

cooling said liquid until frozen together with the numbered balls in said capacity, thawing the frozen liquid until a first one of the numbered balls sinks and falls through the bottom of the capacity under the effect of gravity and exits through said exit tube.

18. The method of claim 17, wherein the mixing step comprises supplying gas into the liquid contained in the capacity in order to mix the numbered balls.

19. The method of claim 17, wherein the mixing step comprises generating a vortex of the liquid to mix the numbered balls.

* * * * *